US006476567B1

(12) United States Patent
Pienisaari

(10) Patent No.: US 6,476,567 B1
(45) Date of Patent: Nov. 5, 2002

(54) CONTROL GEAR FOR FLUORESCENT LAMPS

(75) Inventor: Heikki Pienisaari, Mäntsälä (FI)

(73) Assignee: Innoware Oy, Lahti (FI)

( * ) Notice: Subject to any disclaimer, the term of this patent is extended or adjusted under 35 U.S.C. 154(b) by 0 days.

(21) Appl. No.: 09/701,405

(22) PCT Filed: Mar. 28, 2000

(86) PCT No.: PCT/FI00/00257

§ 371 (c)(1),
(2), (4) Date: Dec. 19, 2000

(87) PCT Pub. No.: WO00/59271

PCT Pub. Date: Oct. 5, 2000

(30) Foreign Application Priority Data

Mar. 31, 1999 (FI) ..... 990719

(51) Int. Cl.[7] ..... H05B 37/02
(52) U.S. Cl. ..... 315/307; 315/209 R; 315/291
(58) Field of Search ..... 315/209 R, 219, 315/220, 224, 225, 226, 291, 307, 362

(56) References Cited

U.S. PATENT DOCUMENTS 6,008,593 A * 12/1999 Ribarich ..... 315/307
6,072,284 A * 6/2000 Lin ..... 315/307
6,188,183 B1 * 2/2001 Greenwood et al. ..... 513/291
6,288,500 B1 * 9/2001 Klier ..... 315/209 R
6,359,387 B1 * 3/2002 Giannopoulos ..... 315/46

FOREIGN PATENT DOCUMENTS

EP 0 558 772 A1 9/1993 ..... H05B/41/29

* cited by examiner

*Primary Examiner*—Don Wong
*Assistant Examiner*—Jimmy T. Vu
(74) *Attorney, Agent, or Firm*—Leydig, Voit & Mayer, Ltd.

(57) ABSTRACT

A control gear for fluorescent lamps, which comprises two or more lamp circuits for igniting and burning fluorescent lamps, the lamp circuits comprising supply and ignition components (L1, C1; L2, C2) specific for each lamp, and a supply line ($V_{dc}$) which is arranged to supply voltage to the lamp circuits. The control gear also comprises a switching element (S1) connected to the supply line and common to all lamp circuits, which element is arranged to stop the supply of all lamp circuits, lamp circuit-specific switching elements (S2, S3) arranged to control the voltage of the lamps in the lamp circuits, a control unit (A) which is arranged to control the common switching element (S1) and the lamp circuit-specific switching elements (S2, S3), and lamp circuit-specific circuits (B2, B2) identifying defective fluorescent lamps, which identifying circuits are arranged to transmit information on defective fluorescent lamps to the control unit (A).

7 Claims, 2 Drawing Sheets

CONTROL GEAR FOR FLUORESCENT LAMPS

BACKGROUND OF THE INVENTION

The present invention relates to a control gear for fluorescent lamps, which comprises two or more lamp circuits for igniting and burning fluorescent lamps, the lamp circuits comprising supply and igniting components specific for each lamp, and a supply line arranged to supply voltage to the lamp circuits.

Fluorescent lamps are generally used owing to their good lighting power. In addition, the long operating life of fluorescent lamps and the various tones of colour available enable their use in various applications.

A control gear is required for burning fluorescent lamps, the control gear supplying the ignition voltage necessary for the fluorescent lamp and the supply voltage necessary during its use. When using several fluorescent lamps connected to a prior art control gear, a problem arises from the fact that when one fluorescent lamp becomes defective, the fluorescent lamps connected to the same control gear cannot continue to function normally. Present control gears do not allow the switching off of a defective lamp without switching off the other lamps connected to the same control gear. This causes problems when lamps are replaced, because replacing one switched-off lamp does not necessarily allow the system to work.

BRIEF DESCRIPTION OF THE INVENTION

It is an object of this invention to provide a control gear for fluorescent lamps, which avoids the above drawbacks and allows one and the same control gear to supply voltage to the fluorescent lamps in such a manner that the operation of one lamp is completely independent from that of the others. This object is achieved by a control gear of the invention characterized in that the control gear also comprises a switching element connected to a supply line and common to all lamp circuits, which element is arranged to cut the supply to all lamp circuits, switching elements specific for each lamp circuit, which elements are arranged to control the voltage of the lamps in the lamp circuits, a control unit arranged to control the common switching element and the switching elements specific for each lamp circuit, and lamp circuit-specific circuits for identifying a defective fluorescent lamp, which are arranged to transmit information on defective fluorescent lamps to the control unit.

The invention is based on the idea that an electronic control gear comprises, for each lamp, circuit switching elements with which the lamps can be controlled separately independent of the control of the other lamps. In normal operation, the switching elements of the lamp circuits are controlled in parallel using the same control. The control gear of the invention also comprises circuits for identifying defective lamps, and on the basis of the error information received from the circuits, the control of the defective lamp can be stopped, and the other fluorescent lamps connected to the same control gear can continue operation undisturbed. The control gear of the invention provides significant advantages with respect to condition control and maintenance of the lamps, since a defective lamp is easy to locate and replace when necessary.

BRIEF DESCRIPTION OF THE FIGURES

In the following, the invention will be described by means of preferred embodiments and with reference to the attached drawings, in which.

DETAILED DESCRIPTION OF THE INVENTION

Figure 1:
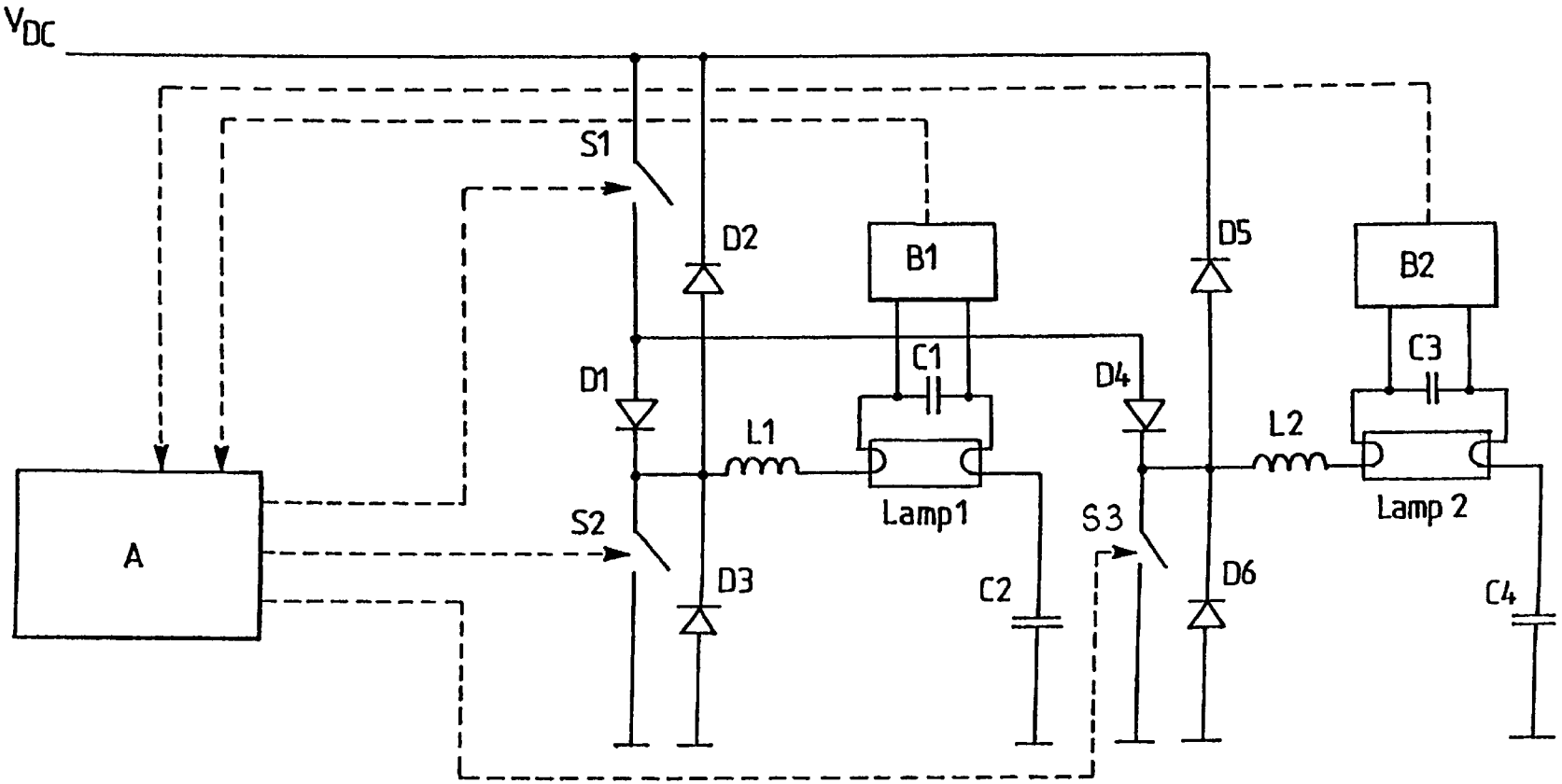
FIGS. 1 and 2 show circuit diagrams illustrating the principle of the control gear of the invention.

FIG. 1 shows a control gear of the invention, to which two lamp circuits comprising lamps Lamp1 and Lamp2 are connected. The control gear of the invention can also comprise several similarly connected lamp circuits, but the figures show only two lamp circuits for simplicity's sake. Each lamp circuit receives its voltage from a supply line Vdc through a switching element S1 common to all lamp circuits.

In FIG. 1, diodes D1 and D4 are connected to the switching element S1, their task being to separate the lamp circuits from each other. An inductive component L1, which is connected the second electrode of the lamp being supplied, is connected to diode D1. Between the electrodes of Lamp1, a capacitance C1 is also connected, which together with the inductive component L1 forms a resonance circuit meant to provide the ignition voltage required to ignite the lamp.

The lamp circuits also comprise switching elements S2, S3 specific for each lamp circuit, whose purpose is to produce the desired alternating voltage from the direct voltage of the supply line Vdc. Both the lamp circuit-specific switching elements and the switching element common to all lamp circuits are controlled by a control unit A. The control unit A comprises the electronics necessary for controlling semiconductor switches. The control unit A receives as input information from identification circuits B1 and B2 of defective lamps in various lamp circuits, whereby the control of defective lamps can be stopped.

Figure 2:
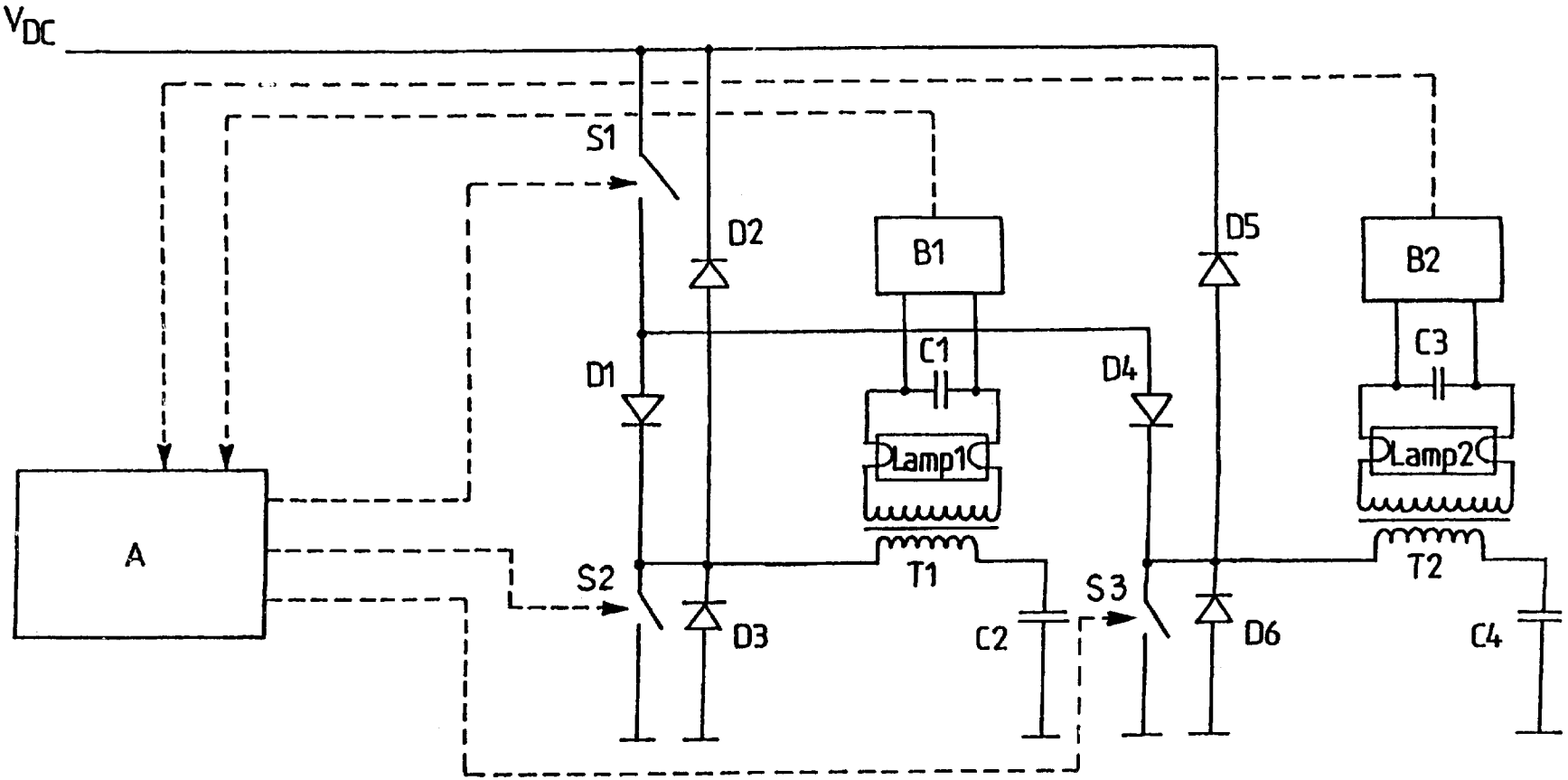

The control gear shown in FIG. 1 operates in such a manner that during ignition of the lamps, the lamp circuit-specific switches are controlled to produce resonance. By means of a resonance voltage generated by the inductive component L1 and the capacitance C1, an ignition voltage is caused, by which the electrodes of the fluorescent lamp can be heated for a gas discharge occurring inside the lamp. In the embodiment in FIG. 1, the inductive component is made up of a series choke, and in the embodiment in FIG. 2, of a transformer T1, T2. When using the transformer connection, series chokes can also be added to the circuit to increase the inductance produced by the distributed inductance of the transformers.

When the fluorescent lamp has been ignited by means of the resonance described above, an alternating voltage of desired magnitude is generated in the lamp by means of the lamp circuit-specific switching elements S2, S3 and the switching element S1 common to all lamp circuits. By switching the switching element at a high frequency to a conducting and blocking state, it is possible to alter the magnitude of the average voltage of the inductive component, thus making it possible to alter, within certain limits, the magnitude of the current passing through the inductive component L1 and, at the same time, through the fluorescent lamp. By changing the state of the switching element S2 at a high frequency in push-pull manner with the switching element S1, and by altering the pulse ratio of the switching elements, it is possible to alter the magnitude of the voltage in the end of the inductive component L1, which is connected to the diode D1.

The task of lamp circuit-specific diodes D2, D3 and D5, D6 is to limit the voltage of the second pole in the inductive component to be between the voltage of the supply line Vdc and the ground potential. The task of capacitances C2 and C4 connected to the second electrodes of the fluorescent lamps is to prevent direct current from passing through the lamp.

The circuits B1 and B2 identifying defective fluorescent lamps are connected over the capacitance C1 and, at the same time, to the electrodes of the fluorescent lamps. The identification circuits check the operation of the fluorescent lamp connected to them and transmit information on a possible defect to the control unit A. In a preferred embodiment of the invention, the identification circuits B1, B2 comprise an element arranged to determine the lamp current, lamp voltage, heating current or a combination thereof. These variables of a fluorescent lamp indicate whether the lamp is operational. If the identification circuits detect that the lamp connected to them is defective, the identification circuits inform the control unit A. After receiving this information, the control unit A can stop controlling the switching element of the lamp circuit connected to the defective lamp. Even though the control unit stops the control of one or more lamp circuits, the control of operational lamps continues uninterrupted. In normal operation, the control unit A controls the switching elements controlling the voltage of the fluorescent lamps in all lamp circuits identically, but the control of the lamps can be changed to differ from each other, if necessary.

Using the control gear of the invention also makes it possible to switch off one or more operational fluorescent lamps in a simple manner by stopping the control of the desired lamp circuit-specific switching elements. This way, one or more lamps connected to the same control gear can be switched off without disturbing the operation of the other lamps connected to the same control gear in any way.

It is obvious to a person skilled in the art that the basic idea of the invention can be implemented in many different ways. Thus, the invention and its embodiments are not restricted to the examples described above, but may vary within the scope of the claims.

What is claimed is:

1. A control gear for fluorescent lamps and the identification of defective fluorescent lamps, said control gear comprising:

two or more lamp circuits for igniting and burning fluorescent lamps, the lamp circuits comprising supply and ignition components specific for each lamp, a supply line which is arranged to supply voltage to the lamp circuits, a switching element connected to the supply line and common to all lamp circuits said switching element being arranged to stop the supply of all lamp circuits, lamp circuit-specific switching elements arranged to control the voltage of the lamps in the lamp circuits, wherein each lamp circuit-specific switching element is arranged to stop the supply voltage to one of the lamp circuits without interrupting the supply voltage to other of the two or more lamp circuits, a control unit arranged to control the switching element and the lamp circuit-specific switching elements, and lamp circuit-specific circuits identifying defective fluorescent lamps, said circuits being arranged to transmit information on defective fluorescent lamps to the control unit.

2. The control gear as claimed in claim 1, wherein the supply and ignition components in the lamp circuits comprise series chokes.

3. The control gear as claimed in claim 1, wherein the supply and ignition components in the lamp circuits comprise transformers.

4. The control gear as claimed in claim 1, wherein the lamp circuit-specific circuits comprise an element arranged to determine the lamp current, lamp voltage, heating current or combination thereof.

5. The control gear as claimed in claim 2, wherein the lamp circuit specific circuits comprise an element arranged to determine the lamp current, lamp voltage, heating current or combination thereof.

6. The control gear as claimed in claim 3, wherein the lamp circuit specific circuits comprise an element arranged to determine the lamp current, lamp voltage, heating current or combination thereof.

7. The control gear as claimed in claim 1, wherein the two or more lamp circuits comprise a first lamp circuit and a second lamp circuit and the switching element and the lamp circuit-specific switching elements cooperate such that a first supply voltage is provided to the first lamp circuit and a second supply voltage is provided to the second lamp circuit, the first supply voltage being distinct from the second supply voltage.

* * * * *